US007765755B2

(12) United States Patent
Williams

(10) Patent No.: US 7,765,755 B2
(45) Date of Patent: Aug. 3, 2010

(54) CEMENT BUILDING SYSTEM AND METHOD

(76) Inventor: Joseph R. Williams, 6355 Griggs Rd., Houston, TX (US) 77023

( * ) Notice: Subject to any disclaimer, the term of this patent is extended or adjusted under 35 U.S.C. 154(b) by 1160 days.

(21) Appl. No.: 10/839,589

(22) Filed: May 5, 2004

(65) Prior Publication Data

US 2005/0247012 A1 Nov. 10, 2005

(51) Int. Cl.
*E04C 1/00* (2006.01)

(52) U.S. Cl. ..... 52/309.9; 52/309.17; 52/223.7

(58) Field of Classification Search ..... 52/309.15, 52/309.17, 309.12, 309.9, 309, 794.1, 223.7, 52/223.9, 223.14, 602; 264/31, 33
See application file for complete search history.

(56) References Cited

U.S. PATENT DOCUMENTS

| | | | | | |
|---|---|---|---|---|---|
| 2,101,538 | A * | 12/1937 | Faber | 52/223.7 |
| 3,300,932 | A * | 1/1967 | Ratliff, Jr. | 52/339 |
| 3,394,523 | A * | 7/1968 | Sackett, Sr. | 52/475.1 |
| 4,030,265 | A * | 6/1977 | Allgood | 52/724.4 |
| 4,259,822 | A * | 4/1981 | McManus | 52/334 |
| 4,454,695 | A * | 6/1984 | Person | 52/334 |
| 4,996,813 | A * | 3/1991 | Kliethermes et al. | 52/592.1 |
| 4,999,964 | A * | 3/1991 | Taylor | 52/477 |
| 5,095,674 | A * | 3/1992 | Huettemann | 52/405.3 |
| 5,181,825 | A * | 1/1993 | Sugitani et al. | 414/800 |
| 5,566,521 | A * | 10/1996 | Andrews et al. | 52/606 |
| 5,673,524 | A * | 10/1997 | Gailey | 52/309.9 |
| 5,918,438 | A * | 7/1999 | South | 52/745.07 |
| 5,921,046 | A * | 7/1999 | Hammond, Jr. | 52/564 |
| 6,000,898 | A * | 12/1999 | Sharp | 414/11 |
| 6,955,014 | B2 * | 10/2005 | LeJeune et al. | 52/223.6 |
| 7,114,695 | B2 * | 10/2006 | DeLoach, Sr. | 249/18 |
| 2003/0079438 | A1 * | 5/2003 | Stephens et al. | 52/782.1 |

* cited by examiner

*Primary Examiner*—David Dunn
*Assistant Examiner*—Daniel Kenny
(74) *Attorney, Agent, or Firm*—Kenneth L. Nash

(57) ABSTRACT

A system and method is provided for a cement building which may utilize cement floor panels, cement wall panels, cement roof panels, cement joist panels, and cement roof support panel. Although each type of cement panel will vary in construction depending on the function, preferably each panel comprises a synthetic foam core and a cement outer shell. Molds may be utilized at the building site or offsite to create the panels which are then secured together to form the building. Once a panel is raised, it is substantially complete thereby reducing time required to complete the building. Floor panels may comprise an internal cement arch to provide a sturdy panel that provides a sturdy support for loads placed thereon.

18 Claims, 6 Drawing Sheets

CEMENT BUILDING SYSTEM AND METHOD

TECHNICAL FIELD

The present invention relates generally to construction and in a preferred embodiment relates more specifically to light weight cement housing construction techniques.

BACKGROUND

It is well known that houses built utilizing conventional wood beams are subject to many problems including a significant cost and time to build, low resistance to fire, limited lifetime as the materials naturally decay, and low resistance to insect damage. Metal structures have been utilized but tend to be costly. Cement or adobe houses have been built but tend to be extremely heavy and difficult to construct.

Consequently, there remains a need for an improved building construction that is light weight, quickly assembled, fire proof, long lasting, very strong, and capable of a wide variety of finishes and designs. Those of skill in the art will appreciate the present invention which addresses the above and other problems.

SUMMARY OF THE INVENTION

An objective of the present invention is to provide an improved building construction system and method.

Another objective of an embodiment of this invention is to provide a building that is comprised of inexpensive building materials, that is highly insulated, that is quickly built, that is long lasting, that is very sturdy, that is fireproof, and that is highly resistant to insects.

Another objective is improved cement panels to form a roof, or a floor, or a wall, or joists, and/or other building components.

These and other objectives, features, and advantages of the present invention will become apparent from the drawings, the descriptions given herein, and the appended claims. However, it will be understood that above-listed objectives and/or advantages of the invention are intended only as an aid in quickly understanding aspects of the invention, are not intended to limit the invention in any way, and therefore do not form a comprehensive or restrictive list of objectives, and/or features, and/or advantages.

Accordingly, the present invention provides a building system for creating a building which may comprise one or more elements such as, for instance, a plurality of panels to form the building wherein each of the plurality of panels may comprise an outer cement shell and an inner synthetic foam core positioned within the cement shell. The synthetic foam core may preferably define one or more openings therein. At least one mold may be utilized to form the panel by creating the cement shell and the inner synthetic foam core which are cemented together within the mold. The mold may be filled with cement to form the outer cement shell around the synthetic foam core.

For convenience and to shorten building time, the mold(s) may be positioned at the building site. In one embodiment, the one or more openings within the inner synthetic foam core comprise one or more arches. Preferably, the one or more arches are filled with cement to form a sturdy structure which may, for instance, be used for a floor panel. In one embodiment, a matrix is provided for receiving a plurality of the floor panels therein to form the floor.

Additionally, one or more metal rods, such as rebar or the like, may extend into the outer cement shell and the synthetic foam core. In another embodiment, such as for a joist, at least one metal rod may extend from one end of the outer cement shell to an opposite end thereof to form a structure that supports the joist when loads are placed thereon.

For roof panels that may be utilized in accord with the present invention, a drain groove formed on at least one of the plurality of panels adjacent an expansion joint to prevent any possibility of leakage through the roof or from condensation at the expansion joint.

A winch system may be provided within the building for moving selected of the plurality of panels to form the walls, roof, or the like.

Accordingly the present invention comprises a method for creating a building at a building site or possibly off site comprising one or more steps such as, for example, creating at least one mold, forming at least one opening in a synthetic foam core and/or positioning the synthetic foam core within the mold and/or creating a plurality of panels by pouring cement into the mold such that the cement forms a cement shell on the synthetic foam core and fills at least one opening in the synthetic foam core. Additional steps may comprise combining the plurality of panels to form the building. The method may comprise creating a plurality of molds for forming floor panels, wall panels, and roof panels. The method may further comprise forming an arch within synthetic foam core, such as in the floor panel to support loads placed on the floor. Other steps may comprise positioning one or more metallic rods within the panel and/or inserting house wiring or pipes within at least one opening. The method may comprise winching a plurality of panels into a selected position and fastening the panels in the selected position utilizing cement pins or other types of pins or connectors.

In another embodiment, a building may comprise a plurality of cement panels. Each panel may comprise a synthetic foam core and a cement shell, a plurality of concrete or other locking pins to interconnect the plurality of cement panels and/or a plurality of rebar reinforcements cemented into the plurality of panels. One or more of the plurality of cement panels may comprise an arched structure formed integral with the panel. One or more of the plurality of cement panels are utilized to form a roof. The cement shell may define a fluid flow line to drain off fluid at expansion joints in the roof between the panels. The building may comprise a cement joist or trusses with a plurality of struts comprised of metal. The method may be utilized for supporting a flat roof as well.

This summary is not intended to be a limitation with respect to the features of the invention as claimed, and this and other objects can be more readily observed and understood in the detailed description of the preferred embodiment and in the claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION OF PREFERRED EMBODIMENTS FOR CARRYING OUT THE INVENTION

Figure 1:
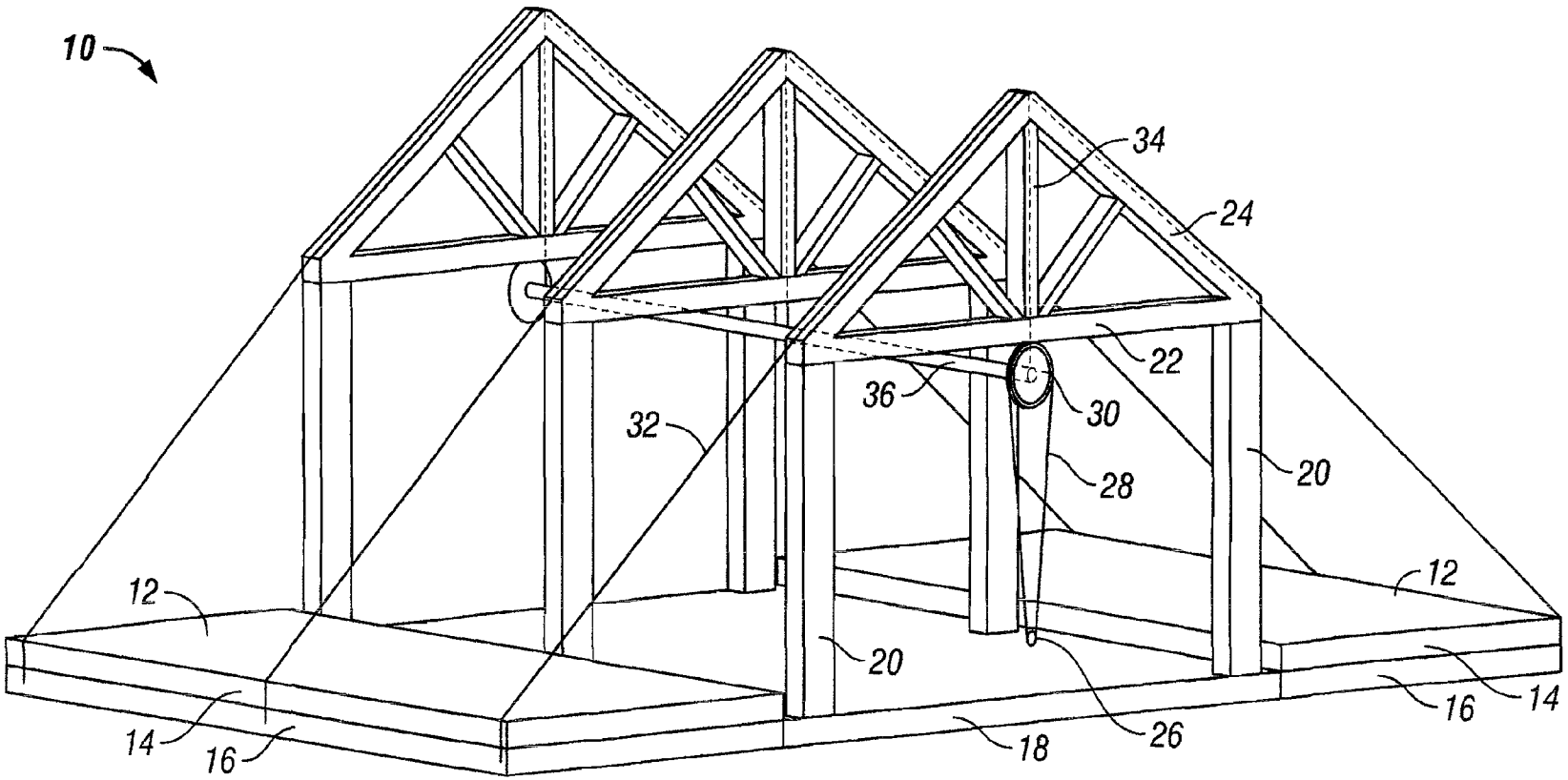
FIG. 1 is a perspective view showing one possible installation method for wall panels and roof panels in accord with the present invention.

Referring now to the drawings and, more particularly to FIG. 1, there is shown building system 10 that may be utilized for quickly constructing a fire proof, long life, highly insulated, sturdy house in accord with the present invention. As used herein, a building may comprise a house or any other suitable structure as contemplated herein.

Wall panels 12 are preferably made on or off site as desired utilizing form frame 14, synthetic foam such as Styrofoam®, and cement. Cement and synthetic foam will never decompose, thereby providing for a very long lasting house that is substantially impervious to insects, fire, flooding, and rot. In a preferred embodiment, wall panels 12 are of light weight construction because the bulk of the wall panels is comprised of synthetic foam, which is surrounded with cement, as discussed in more detail hereinafter. The cement outer surfaces can be stained and patterned to emulate virtually any desirable outer surface from brick, tile, as well as lustrous surfaces including leather and the like. Although the panels are largely synthetic foam, the panels have significant strength because the synthetic foam may comprise grids or openings formed thereon in preferred shapes, such as arches, columns and beams, as discussed hereinafter. Form base 16 comprises a wood or metal platform or other suitable support for form 14 which is used to make wall panels 12 and to provide support for wall panels 12 as they are raised into an upright position. Foundation 18 supports the framework of the building such as uprights 20, joists or trusses 22, and roof supports 24. Uprights 20 may be permanent structures or may simply be utilized to temporarily support the frame until wall panels are lifted whereby uprights 20 may then be removed or partially removed, if desired, depending on the design, purpose, and architectural effect. Uprights 20 may also, if desired, fit into slots or sections (not shown) in panel 12 thereby becoming part of the wall. In this case, uprights 20 may be secured to panels 12 with cement pins, rebar, or other retaining means as discussed hereinafter.

After the cement in forms 14 sets, then wall panels 12 can be raised utilizing a winch system, jacks, fulcrums or other type of lifting system which does not necessarily require expensive heavy equipment such as cranes. Thus, one type of possible cost saving is the lack of need for heavy equipment. One example of a winch system for raising wall panels 12 comprises a drive 26 which may be a motor driving a small pulley. In this embodiment, chain or rope drive 28 rotates larger pulley 30. Guide wire 32 goes along roof support 24 to the peak thereof, and then downwardly as indicated at 34 to tubular 36 which is rotated by pulley 30. As guide wire 32 wraps around tubular 36 wall panel 12 is lifted upwardly until it is in positions whereupon wall panel 12 may be secured with any suitable fasteners and/or cement. Guide wire 32 may be attached to form 16 to provide support for wall panel 12 until wall panel 12 is in an upright position. Wall panels may or may not have internal support arches in the synthetic foam therein but will preferably have hollow portions that may be utilized for built in duct work, electrical wiring, pipes, and the like.

Figure 5:
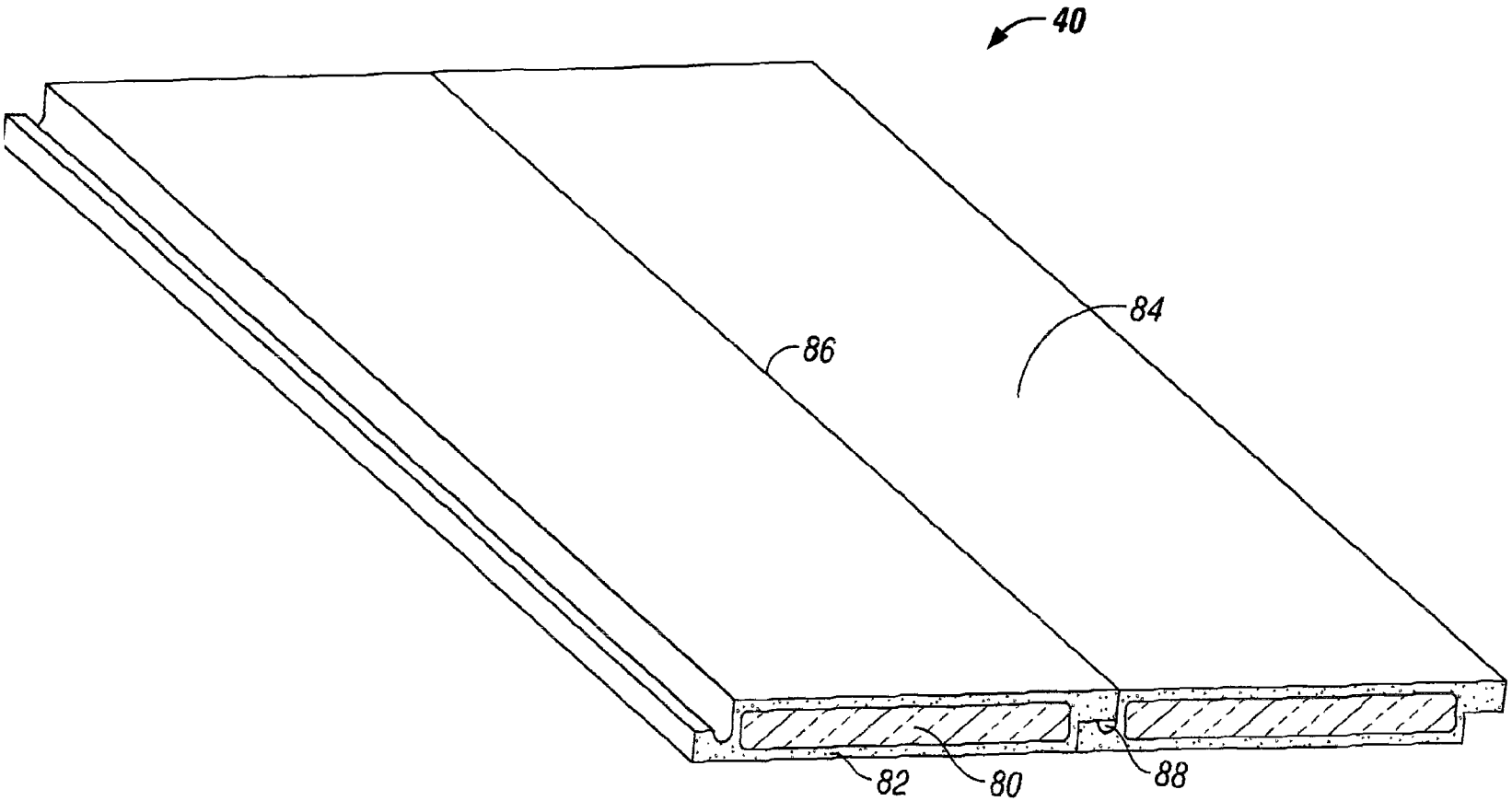
FIG. 5 is a perspective view, in cross-section, showing a roof panel comprising cement and styrofoam in accord with one possible embodiment of the present invention.

Roof panels, such as roof panel 40 of FIG. 5, may also be lifted in position on the roof by the guide wires. However, in this case, the roof panels are pulled over the roof frame by the guide wires rather than simply being pulled to the upright position. Suitable angled ramps (not shown) and the like may be provided for supporting roof panels 40 as roof panels are pulled into position by the guide wires until roof panels 40 are supported by roof supports 24. The forms for the roof panels are quite simple to make and once the cement is hardened, the roof panels and wall panels are moved directly into position.

The inner outer and/or outer surfaces of the wall panels and/or roof panels can be treated, such as by stains or the like, either before or after being raised as is most convenient. Any windows, wiring, doors, plumbing vents, or the like, may be placed in the wall prior to cementing. Once the wall is up, then the wall may then be essentially complete. Concrete columns may be poured into the wall panels for additional strength. Similarly, any skylights or the like may be placed on roof panel 40. Texturing and/or staining to any desired upper roof surface appearance is preferably accomplished while the roof is on the ground, for safety reasons such that little work is actually required on the roof thereby greatly reducing the dangers to construction workers. Once the roof is pulled in position by guide wires 32 and secured, the roof is complete. No additional work or layers of material such as roofing paper, roofing tiles, and the like need to be installed as with presently required for many roofs thereby reducing time and cost of construction. Therefore, the process of building the house goes rather quickly as compared to standard building processes.

Figure 2:
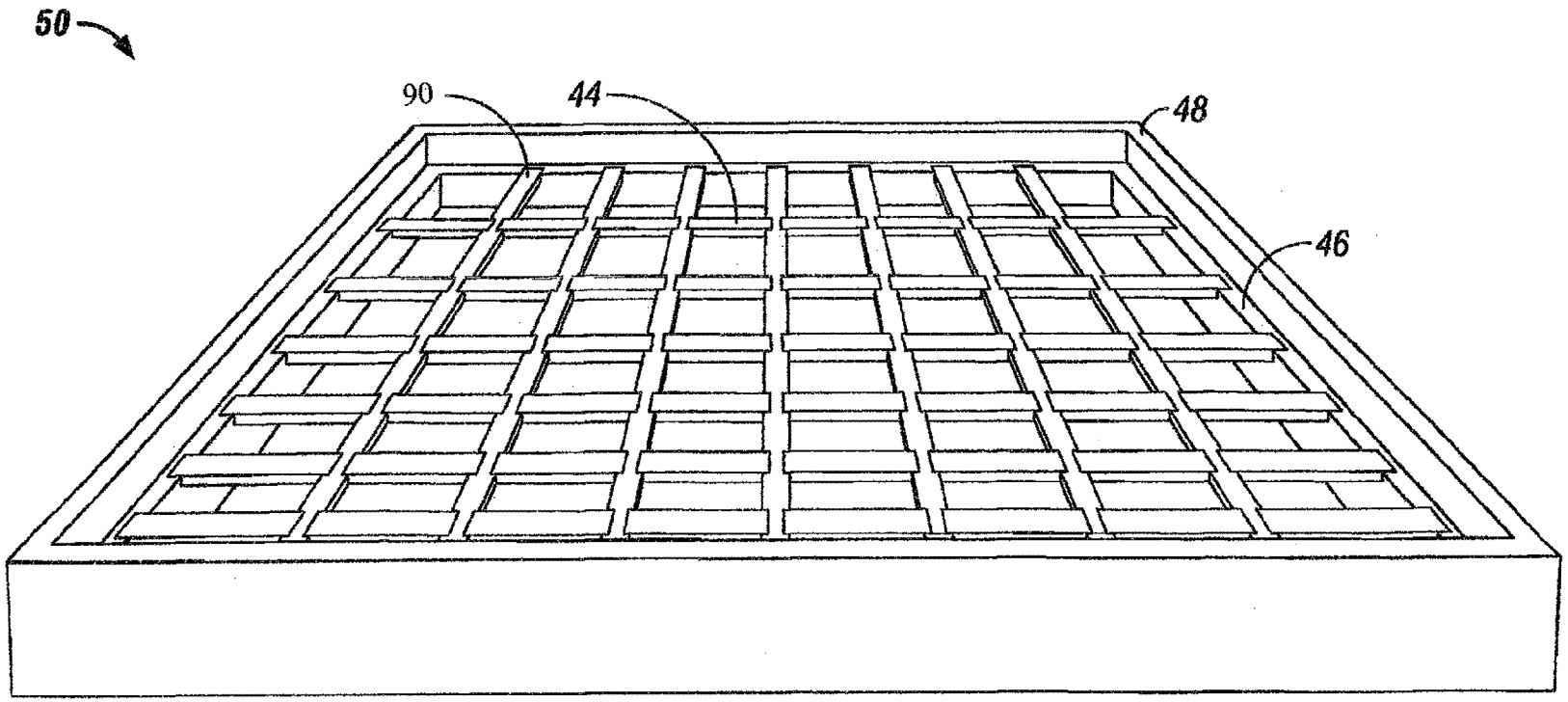
FIG. 2 is a perspective view showing a floor panel installation grid in accord with one possible embodiment of the present invention.
Figure 3:
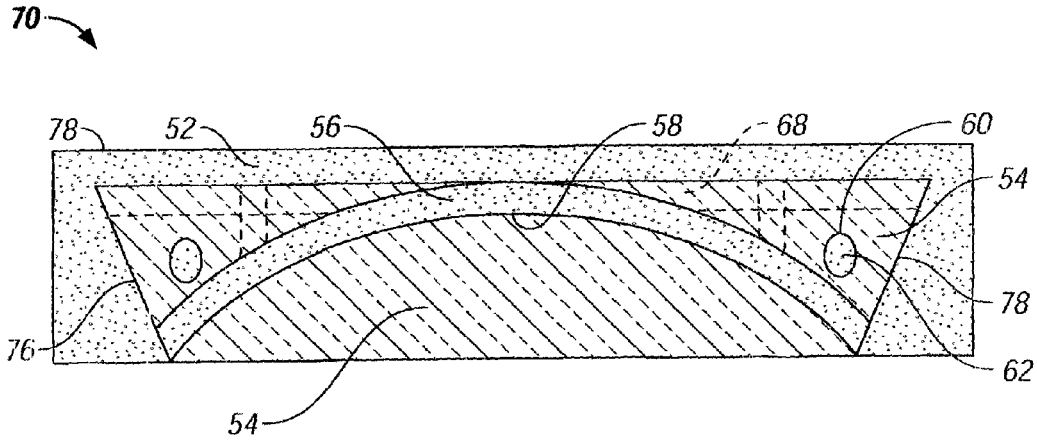
FIG. 3 is an elevational view, in cross-section, of a high strength floor panel comprising cement arches formed within synthetic foam, the whole encased in a cement shell, in accord with one possible embodiment of the present invention.
Figure 4:
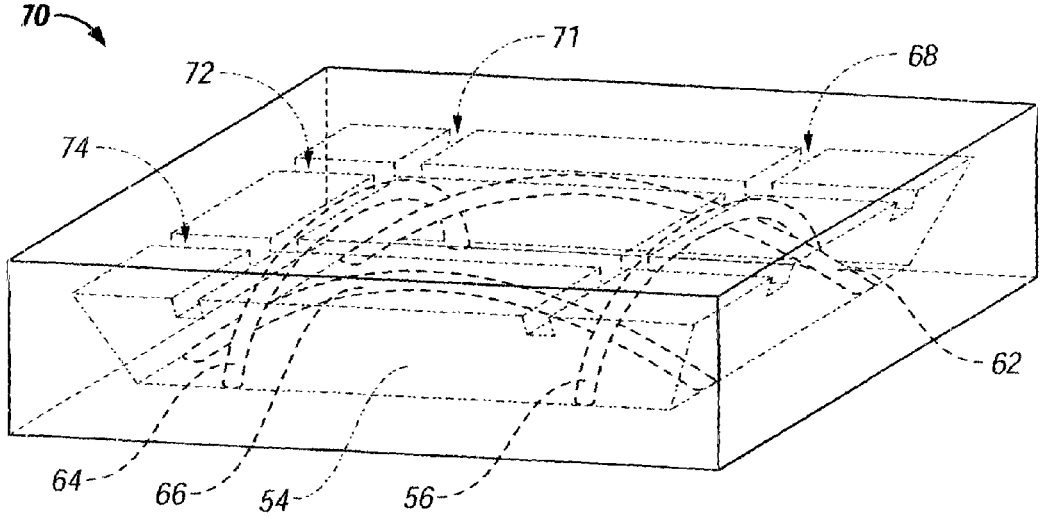
FIG. 4 is a perspective view, partially in cross-section, showing a more complete view of the floor panel construction of FIG. 3 in accord with one possible embodiment of the present invention.

FIG. 2 discloses a preferred matrix 50 for mounting floor panels 70 shown in FIG. 3 and FIG. 4. Matrix 50 comprises joists 90 (see FIG. 6) and matrix separators 44. Matrix separators 44 may simply be beams or members which are inserted into notches formed in joists 90. However matrix separator 44 may be mounted between joists 90 by any suitable connection means as desired. External support frame 46 may be utilized to support joists 90 and separators 44.

Floor panels 70 are made in a separate form and then inserted into matrix 50. In another conceivable embodiment, matrix 50 may utilize form 48 whereby the cement is poured into matrix 50 after inserting synthetic core 54 (See FIG. 3) as discussed below to provide a quickly made but sturdy and potentially very beautiful floor. Each floor panel 70 is lightweight but very strong.

FIG. 3 shows a cross-section of one preferred embodiment of a floor panel in accord with the present invention. Floor panel 70 comprises cement shell 52 which may or may not completely surround synthetic foam core 54. It will be appreciated by those of skill in the art in reviewing FIG. 3 that because the majority of the bulk of the floor panel 70, generally fifty to eighty percent, is comprised of synthetic foam, floor panel 70 has a relatively light weight. However, floor panel 70 is also unusually strong and, due to the internal structures thereof, has been found to flex much less than the amount permitted according to building codes with a specified weight placed thereon. In a preferred embodiment, cement arches 56 are formed within synthetic foam core 54. Prior to pouring the cement, arched apertures are formed in the synthetic foam. One way to form the apertures, holes, or conduits is to use a heated rod which very quickly and easily can be used to form holes in the synthetic foam. The rod is shaped in the desired manner and, after heating, is quickly inserted through the synthetic foam core 54 to form arched aperture 58 and/or other apertures, such as aperture 60, or columns, grids, and any structural support shapes as desired. The arched apertures, grids, columns, and/or virtually any internal support shapes are filled with cement as the cement is poured.

In FIG. 4 some various internal arches are seen from a perspective view. In the example of FIG. 4 arches 56 and 64 are oriented in a first direction and arches 62 and 66 are oriented in another direction, such as at a right angle therewith. Panels 70 may be square, rectangular, octagonal, round, or otherwise shaped as desired, whereby the arches may be substantially the same length or may be of varying lengths with respect to each other. As well, support grids, which will be filled with cement, may be formed by making apertures or slots such as slots 68 and 71 which intersect with slots 72 and 74. Grids are very easily and quickly made on the surface of synthetic foam core 54. However, grids could also be formed internally, if desired. It will be understood that the arches and/or grids, which are filled with cement, form a very sturdy structure after the cement sets. In one preferred embodiment, edges 76 and 78 of synthetic foam core 54 are sloping to thereby more directly reinforce the internal arches such as arch 56. As discussed in connection with FIG. 6, this sloping also provides more latitude for mounting purposes. However, it is not required to have edges 76 and 78 sloping. The edges may be square or shaped as desired.

The surface 79 of floor panel 70 can be stained and/or shaped as desired to produce a beautiful finish. For instance, a tile form (not shown) can be inserted at the top of panel 70 whereby the original cement or an added cement top may take on a tiled appearance. After staining, the cement may appear to be wood, leather, tile, or virtually any other textured material. Thus, a beautiful, lightweight, long-lasting, and strong floor is formed in accord with the present invention. Any pipes, radiant heating members, wiring, or other desirable elements, openings, air paths, or the like may be inserted and/or molded into the floor prior to cementing.

FIG. 5 shows roof panel 40 in accord with the present invention. Roof panel 40 also comprises synthetic foam core 80 and cement shell 82. Outer surface 84 of shell 82 can be made to appear to be any texture such as tiles or the like which is readily determined by a desired mold (not shown) which may be a lightweight plastic mold that is inserted prior to or just after pouring the cement. In this embodiment, roof panels 40 are formed in sections whereby temperature expansion/contraction joints 86 permit some movement to compensate for temperature variations encountered by the roof. Drain Groove 88 is preferably provided in the vicinity of temperature expansion/contraction joint 86 to collect any water that may seep through joint 86 and drain the water off to a desirable location. Roof panel 40 will preferably be a finished product once it is in position, thereby virtually eliminating the need for workers to be work on roofs, and preventing the many accidents that occur. Thus, the present overall roof construction is faster, more durable, safer, and will have any desired texture that is presently available as well as additional possible textures and designs. Depending on the length of roof panels 84, joists may or may not be required.

Figure 6:
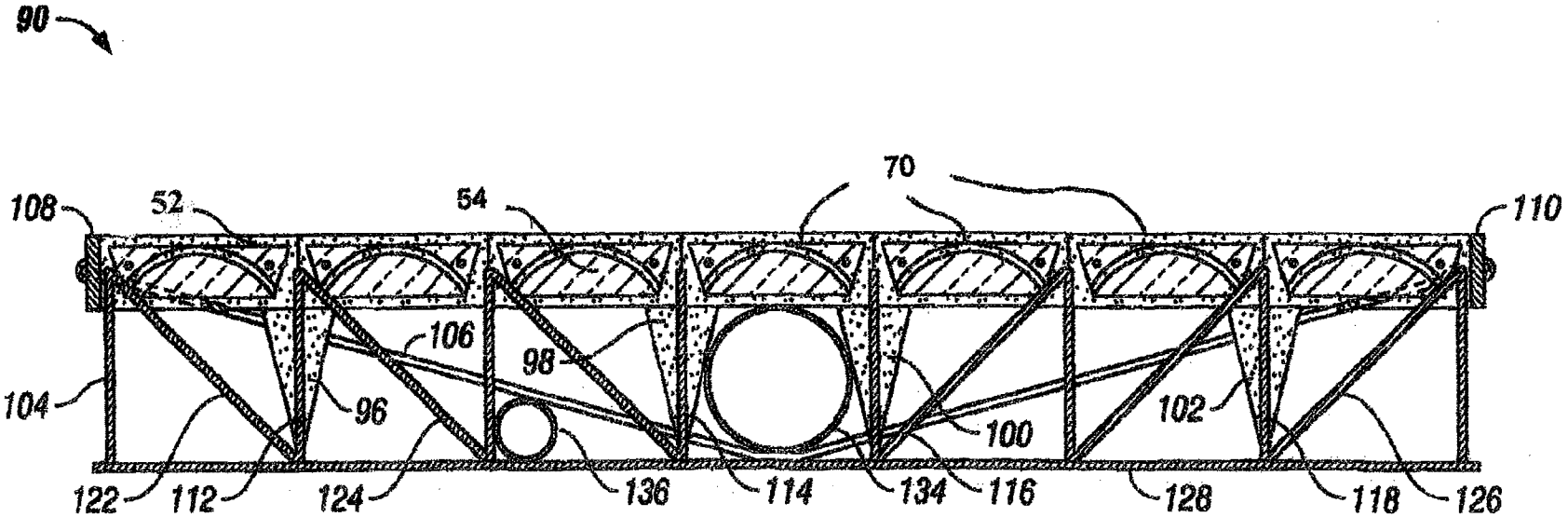
FIG. 6 is an elevational view, partially in cross-section, showing a floor joist in accord with one possible embodiment of the present invention.

FIG. 6 shows one embodiment of a presently preferred lightweight floor joist or beam 90 which may be utilized to support large loads (which is seen as joist 90 in FIG. 2). In one embodiment, joist 90 may be effectively comprised of synthetic foam cores 54 (also shown individually shown as foam core 54 in FIG. 3), cement cones 96, 98, 100, and 102, frame members 104, 112, 114, 118, 122, 124, 126 and tensioner member 106. Frame members 104, 112, 114, 118 may be rebar, angle iron, or any suitable material to provide compressive strength. It will be understood that rebar is very inexpensive, and therefore provides a strong but low cost construction material. Tensioner member 106 may be rebar, cable, or any suitable material which provides tensional strength. Additional frame members 122, 124, 126 provide mainly tensional strength and may be rebar, angle iron, cables, or any suitable materials. Frame member 104 and tensioner member 106 member are preferably cemented into beam 90. Rebar tensioner 106 is secured by any suitable means such as welding or bolts to outer plates 108 and 110. Outer plates 108 and 110 may be substantially U-shaped if seen from the top to wrap around the ends of joist 90. Outer plates 108 and 110 are mounted on opposite ends of cement shell 52.

When a load is placed on joist 90, then tensioner 106 tightens to resist bending or cracking of joist 90. Joist 90 thereby resists flexing or bending in response to loads placed thereon. In fact, most bending occurs after the initial load is placed on joist 90 and the initial "slack" in tensioner 106 is taken up causing a post tension, whereupon almost no bending occurs thereafter. This is in contrast to most beams or joists which continually bend more as more load is placed thereon. With the initial loading for standard testing, joist 90 bends about one-third as much as a typical construction beam. However, with additional loads there is very little additional bending. Moreover, the material cost of joist 90 is very low, and is in fact lower than the cost of 2×4×12 wood joists which are not nearly as strong.

Cement cones 96, 98, 100, and 102 may or may not be formed around corresponding substantially vertical struts 112, 114, 116, and 118. The use of the cement cones further reinforces the compression load. The cement cones also strengthen the interconnection of the support members with cement shell 52 and synthetic foam core 54. In one presently preferred embodiment as indicated above, rebar forms the vertical struts 112, 114, 116, and 118 and also diagonal rebar struts such as 122, 124, 126, and the like, as indicated in FIG. 6. However, as also indicated above, other material such as angle iron, iron bars, or the like may also be utilized. A horizontal strut 128 is welded to the vertical and diagonal struts to form a sturdy frame. The combination of the frame so formed and tensioner 106 produces a very strong joist that resists bending. The joist bends or flexes much less under loads than the upper limit as per building standard requirements. Note tensioner 106 may not be even be required for shorter joists or where supports are provided along the joist, or where the anticipated load is not great. Pipes such as large air conditioning conduit 134 and/or water pipe 136 may be inserted in the space within lightweight joist 90 as desired.

While the above shows a beam or joist 90, the structure may be repeated to form a floor such as an upper floor. For instance several frames such as shown above may be positioned adjacent to each other and substantially parallel to support a floor. If desired, several similar frames might also be formed transverse to the others to prevent bending in the transverse direction and for interconnection of the overall building together. As noted above, while rebar provides a suitably strong and relatively lightweight material for reinforcement purposes, other suitable rods, beams, and the like, such as angle iron, may be utilized in its place, if desired.

Figure 7:
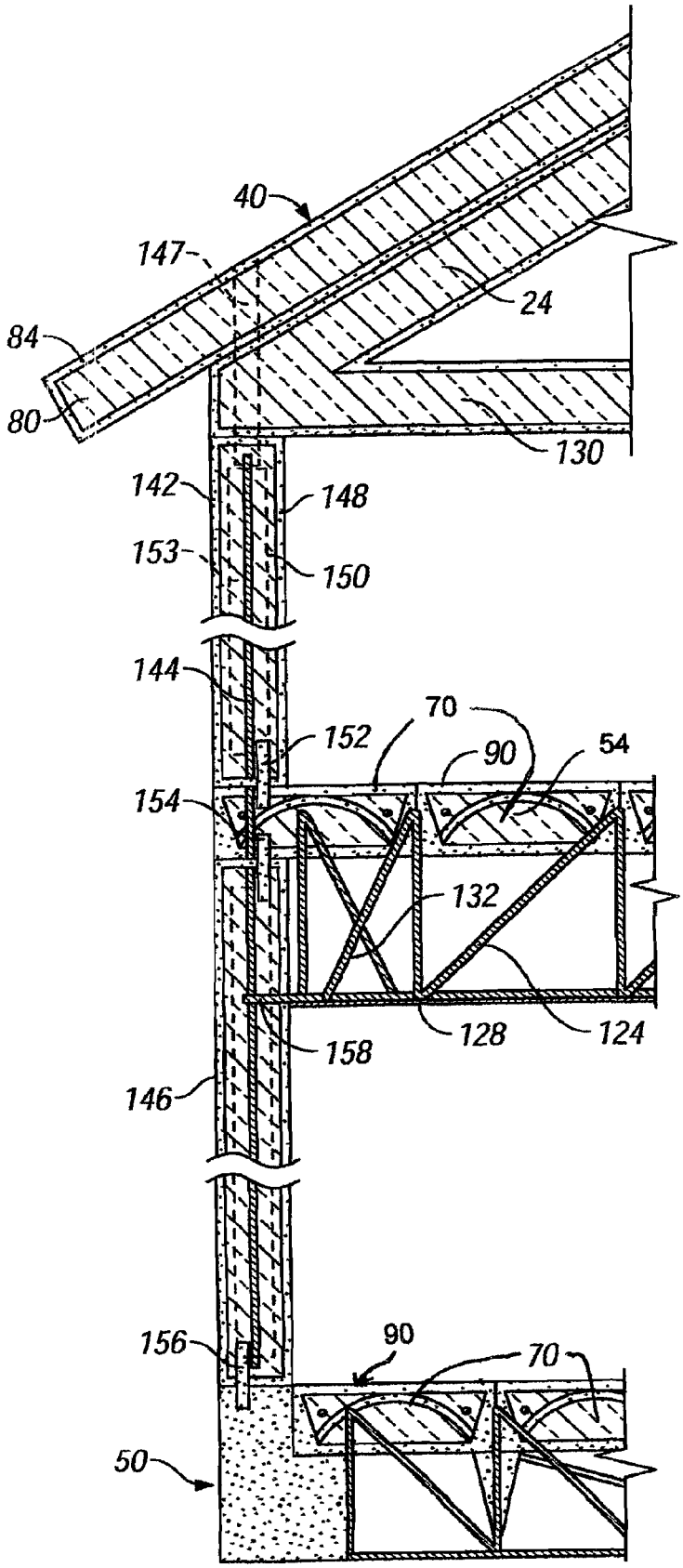
FIG. 7 is an elevational view, in cross-section, showing possible framing details for a house or building in accord with one possible embodiment of the present invention.

FIG. 7 shows framing details for a house in accord with one possible embodiment of the present invention which may utilize components discussed hereinbefore or constructed in similar fashion such as roof support 24, roof panel 40, roof truss 130, floor joist 90, and floor panels 70. Some variations may be provided in construction of these elements depending on the load and so forth. For instance, roof truss 130 and synthetic foam core 54 may or may not comprise rebar reinforcements, as desired. It will be noted that while rebar struts such as diagonal strut 124 and horizontal strut 128 are utilized in joist 90, that rebar tensioner 106 (See FIG. 6) may or may not be utilized depending on the span required. As well, the rebar struts may be concentrated at certain portions such as in reinforcement region 132 wherein the rebar struts are more closely placed together to provide additional strength in a particular region of joist 90.

Reinforcements, such as rebar or other types of suitable reinforcement materials, may be utilized to effectively tie all the components discussed above together so that the building is sturdily bound together. For this purpose, upper wall 142 and lower wall 146 may comprise rebar reinforcements 144 which may be welded to or connected with rebar or other structural elements from other components. For instance, locking pin 147 which connects roof panel 40, roof supports 24 and 130, and upper wall 142 may be formed by providing a hole in these components into which cement may be poured to thereby secure the cement and steel components together. If desired, rebar may be included with the cement that is utilized to form locking pin 147 thereby providing additional strength. One or more holes may also be provided for one or more additional cement and/or rebar locking pins 152, 154, and/or 156, as desired for providing the required connection strength. Hollow sections in walls may be used as ductwork which is already installed and insulated with no additional work required. Plumbing may also be included therein. Upper and lower wall panels 142 and 146 may be any desired width.

Joist 90 may also be secured to wall 146 by means of a rebar extension 158 which may extend outwardly from horizontal rebar strut 128 into a socket that permits some lateral movement.

It will be noted that upper wall 142 and lower wall 146 may also be comprised of cement shell 148 and synthetic foam core 150. Additional hollow gaps 153 may be provided within synthetic foam core 150 for water lines, electricity lines, other lines, and for rebar reinforcements 144. As indicated previously in FIG. 1, cement may be poured into forms that are utilized to form upper wall 142 and lower wall 146, prior to raising the wall to the desired position in the housing. Additional concrete columns may be poured and/or rebar added after the walls are raised for locking the structures together. If desired, multiple rebar reinforcement elements, such as rebar reinforcement 144, may be utilized in upper wall 142 and lower wall 146. It will also be understood, that posts, uprights 20, or the like, as illustrated in FIG. 1 as may be constructed with the same cross-section shown for walls 142 and 146 in FIG. 7. As indicated before, uprights 20 shown in FIG. 1 may be temporary supports that are removed after the wall panels 142 and 146 are upright and completed. Alternatively, a combination of wall panels and/or uprights may be utilized.

Accordingly, the present invention provides for a sturdy house or building comprised of lightweight panels. Generally, the lightweight panels preferably comprise an outer cement shell and an inner synthetic foam core. The synthetic foam core may comprise openings which are filled with cement during formation of the panel and/or which remain open so that concrete may later be poured therein to form a locking pin. The panels may or may not comprise rebar or other strengtheners depending on the use, the span, and the predicted load strength required. The panels are substantially complete after being poured, and then raised to the desired position in the house or building. The panels may stained for a desired color and finish before or after raising. The basic structural building components, cement, synthetic foam, and reinforcements, tend to be much less expensive than presently available building components. The time of building tends to be faster as well since the main time consuming steps simply involve the time for the cement to harden. The resulting building structure is very strong, low cost, substantially fireproof, substantially termite proof, flood proof, and very long lasting.

While the different panels discussed herein can be utilized to create an entire building, it will be understood that the panels could be utilized to form components of more standard buildings. For instance, the roof panels could be utilized for replacing existing roofs to thereby provide for permanent, fireproof roofs having any desired texture. The floor panels could be utilized to create a beautiful floor or portion of a floor.

As used herein synthetic foam or Styrofoam® may comprise foamed plastic or polystyrene. Synthetic foam may preferably comprise a light resilient foam of polystyrene, or any suitable synthetic foam material. More particularly, synthetic foam material may comprise large molecules such as polymers derived from petrochemicals.

Cement, as used herein may comprise a building material and may comprise mortar or concrete. Cement and/or concrete and/or mortar may be used interchangeably herein to describe hard compact building material formed when a mixture of cement, sand, gravel, and water undergoes hydration. Cement may refer to Portland cement which when mixed with sand, gravel, and water forms concrete. Generally, cement is effectively an adhesive or binding material. Cement may be comprised of volcanic ash or other materials as well. Preferably cement as used herein is a powder, which may be made of a mixture of calcined limestone and clay and which may be used with water and sand or gravel to make concrete and mortar. Cement may comprise finely powdered mixtures of inorganic compounds which when combined with water, harden with hydration. Cement may also comprise a dry powder made from silica and/or alumina and/or lime and/or iron oxide and/or magnesia which hardens when mixed with water. In concrete work, cement may comprise the dry powder that, when it has combined chemically with the water in the mix, cements the particles of aggregate together to form concrete. Cement may comprise a substance that can be used to build together aggregates of sand or stone into a cohesive structure. Cement may comprise a single compound or a mixture. Cement may be hydraulic set, air set, or chemical set.

Thus, the foregoing disclosure and description of the invention is therefore illustrative and explanatory of one or more presently preferred embodiments of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. It will be seen that various changes and alternatives may be used that are contained within the spirit of the invention. Moreover, it will be understood that various directions such as "upper," "lower," "bottom," "top," "left," "right," "inwardly," "outwardly," "horizontal," "vertical," and so forth, are made only with respect to easier explanation in conjunction with the drawings and that the components may be oriented differently, for instance, during manufacturing as well as final positioning. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

It is claimed:

1. A building method for creating a building, comprising:

providing a plurality of wall panels to form said building comprising, an outer cement shell, and an inner synthetic foam core positioned within said outer cement shell, said inner synthetic foam core defining one or more openings therein to create structural supports to be filled with cement or concrete;

utilizing at least one mold, said at least one mold being positioned with a largest area side of said mold is in a substantially horizontal position to thereby be operable to receive said cement or concrete as said cement is poured into said mold to thereby form said outer cement shell around said inner synthetic foam, said outer cement shell and said inner synthetic foam core being bonded together within said mold, said mold not containing rebar as said cement is poured into said mold prior to lifting said mold, said mold and said outer cement shell and said inner synthetic foam being secured together so as to be operable for pivotal movement to an upright position whereby during lifting said mold provides support to said outer cement shell and said inner synthetic foam during said pivotal movement to said upright position; and attaching a lifting mechanism to said at least one mold for pivoting said mold such that said mold supports said outer cement shell and said inner synthetic foam during said pivotal movement to said upright position.

2. The building method of claim 1 comprising positioning said at least one mold at a building site for said pivotal movement such that whereupon completion of said pivotal movement to said upright position, said plurality of wall panels are positioned to be secured to form a wall of said building utilizing locking pins comprising cement pins.

3. The building method of claim 1, comprising forming a plurality of floor panels which are molded without rebar by forming one or more openings within a plurality of inner synthetic foam cores whereupon said one or more openings are filled with cement as cement is poured to thereby produce at least two cement or concrete arches within said plurality of floor panels which are transverse with respect to each other and a concrete outer surface for each of said plurality of floor panels.

4. The building method of claim 3, wherein said at least two arches are arranged to prevent bending of said floor panel by providing that said at least two arches or columns or beams are positioned at an interior portion of said inner synthetic foam core so as to be completely encircled by said inner synthetic foam and at least the ends of said at least two arches contact with and are cemented to said outer cement shell.

5. The building method of claim 1, further comprising at least two uprights at corners of said building and wherein at least one of said plurality of panels is a single wall panel, said single wall panel being molded so as to be sized to continuously span a distance between said two uprights.

6. The building method of claim 1, comprising securing a plurality of floor panels together to form a floor, and providing at least one joist for supporting said plurality of floor panels, providing that said at least one joist utilizes at least one tensioner member with opposing ends secured to respective plates on opposite sides of said floor whereby said at least one tensioner member urges said plurality of floor panels towards each other, said at least one tensioner member being angled with respect to a horizontal surface of said floor, said tensioner member being placed in tension that straightens respective ends of said tensioner member so that said respective ends are straight when weight is placed on said floor to resist bending of said at least one joist such that a downward force on said floor creates a horizontal compressive force on said plurality of floor panels of said floor between said opposing ends of said at least one tensioner.

7. The building method of claim 1, providing at least two roof panels adjacent each other, said at least two roof panels defining a drain groove therebetween, said drain groove being defined between a first cement flange and a second cement flange which are overlapping with respect to each other.

8. The building method of claim 1, further comprising providing at least one roof support, wherein said lifting mechanism is configured for moving said plurality of wall panels into position without use of a crane, said lifting mechanism comprises at least one cable secured to said at least one mold and engages said at least one roof support.

9. A method for creating a building, comprising:

creating at least one mold at a building site or off site;

positioning said mold horizontally;

positioning a synthetic foam core within said mold;

providing that said horizontally positioned mold does not include rebar therein prior to pouring cement;

creating a plurality of wall panels by pouring cement into said mold such that said cement forms a cement shell on said synthetic foam core;

providing said mold with at least one of a pattern or stain to provide a finish for an exterior surface on said plurality of wall panels while said mold is horizontal;

providing said wall panels with hollow portions defined therein during said pouring of said cement into said mold to thereby provide spacing for duct work; and combining said plurality of wall panels to form walls of said building.

10. The method of claim 9, further comprising:

creating a plurality of roof panels, which comprise overlapping cement flanges that define drain grooves.

11. The method of claim 9, further comprising creating a plurality of floor panels by forming a hollowed out arch internally within a floor panel synthetic foam core, filling said arch with cement or concrete as said cement is poured and aligning said plurality of cement arches to produce a plurality of aligned arches in said plurality of floor panels.

12. The method of claim 9, further comprising forming a floor panel with at least two cement arches disposed internally within said synthetic foam core, said at least two cement arches being transverse with respect to each other.

13. The method of claim 9, further comprising creating a plurality of floor panels for a floor, providing at least one joist for supporting said plurality of floor panels, said at least one joist comprising at least one tensioner member, and securing opposite ends of said at least one tensioner member to plates on opposite sides of said floor such that a downward force on said floor that straightens respective ends of said tensioner member so that said respective ends are straight and creates a horizontal compressive force to push inwardly against said plurality of floor panels between said opposite ends of said at least one tensioner member.

14. The method of claim 9, further comprising providing a plurality of roof panels and fastening a plurality of wall panels with concrete pins formed by pouring cement into holes in said wall panels.

15. A building system comprising:

a plurality of synthetic foam cores and a plurality of cement shells bonded together to form a plurality of floor panels which in combination form a floor, a plurality of plates on opposite sides of said floor; and at least one joist comprising at least one vertical compressive support members and at least one tensioner member comprising opposite ends and being angled with respect to a horizontal surface of said floor, said opposite ends of said at least one tensioner member being secured to respective of said plates on opposite sides of said floor such that weight placed on said floor produces a compressive force in said compressive support members and a tension force within said least one tensioner member whereby an increase in tension on said at least one tensioner member occurs in response to said weight to create a compressive horizontal force on said plurality of floor panels of said floor between said opposite ends of said at least one tensioner member, each of said opposite ends of said tensioner member comprising a straight segment between said plates and a central portion of said tensioner member.

16. The building system of claim 15, further comprising providing at least one cement arch in each of said plurality of floor panels to produce a plurality of aligned arches in said plurality of floor panels.

17. The building system of claim 15, further comprising a plurality of synthetic foam cores and a single cement shell bonded together to form a single wall panel which covers an entire expanse of one side of said building.

18. The building system of claim 15, further comprising one or more concrete pins for securing a wall panel to one or more roof panels and to said floor.

* * * * *